US007673565B1

(12) United States Patent
Proctor

(10) Patent No.: US 7,673,565 B1
(45) Date of Patent: Mar. 9, 2010

(54) INFRA RED PROXIMITY FUZES

(75) Inventor: James Proctor, Langford (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 05/843,051

(22) Filed: Oct. 13, 1977

(30) Foreign Application Priority Data

Oct. 14, 1976 (GB) ..... 42696/76

(51) Int. Cl.
*F42C 13/02* (2006.01)

(52) U.S. Cl. ..... 102/213; 244/3.16

(58) Field of Classification Search ..... 102/213; 244/3.16

See application file for complete search history.

(56) References Cited

U.S. PATENT DOCUMENTS 3,149,231 A * 9/1964 Ravich ..... 102/213
3,621,784 A * 11/1971 Mundie et al. ..... 102/213
3,727,553 A * 4/1973 Godfrey ..... 102/213
3,742,239 A * 6/1973 Gale ..... 102/213
3,744,423 A * 7/1973 Ertsgaard ..... 102/213
3,899,976 A * 8/1975 Harding et al. ..... 102/213
3,924,536 A * 12/1975 Dick et al. ..... 102/213

OTHER PUBLICATIONS

Hoesterey, Howard F.; "Materials for Infrared Windows, Domes, Lenses" *Electronics*; Jan. 16, 1959 pp. 56&57.*

* cited by examiner

*Primary Examiner*—James S Bergin
(74) *Attorney, Agent, or Firm*—Nixon & Vanderhye P.C.

(57) ABSTRACT

An infra-red proximity fuze system for a homing missile is provided that has Mercury Cadmium Telluride detector cells cooled to at least −40° C., and a frequency response range of 5-7 microns, so as to be sensitive to target skin radiation due to kinetic heating and insensitive to jet-exhaust plume radiation. Three optics/detector modules are equidistantly spaced around the missile axis and each has first and second detector elements the three first elements being connected in a common channel to constitute a guard beam and the three second elements being likewise connected to constitute a firing beam, the guard beam field being displaced angularly from the firing beam field in the forward missile axis direction by about 6°.

12 Claims, 3 Drawing Sheets

Figure 1:
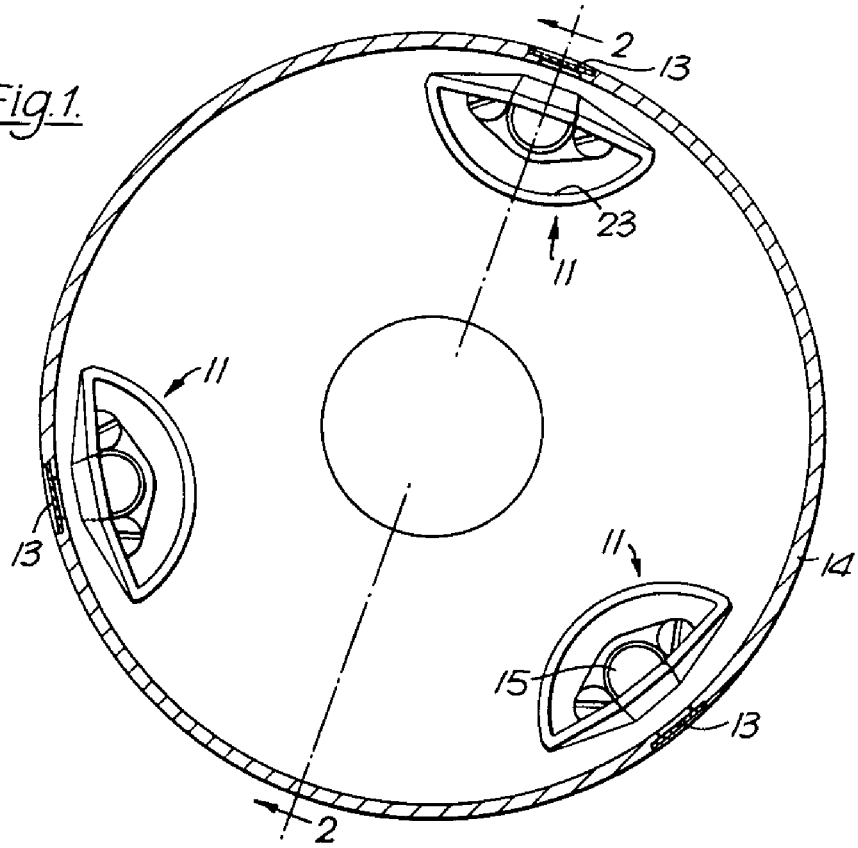

POWER SUPPLY.
TEMPERATURE COMPENSATED DETECTOR POLARISING SUPPLY.
22
TO ALL DETECTORS
COOLER SUPPLY
21
DETECTOR COOLER.
17
DETECTOR COOLER.
DETECTOR COOLER.
17
16
DETECTOR A.
DETECTOR B.
DETECTOR A.
DETECTOR B.
DETECTOR A.
DETECTOR B.
SUMMING AMPLIFIER
18
SUMMING AMPLIFIER
18
20
20
THRESHOLD A
19
THRESHOLD B
19
LOGIC AND DELAY.
26
OUTPUT DRIVE CIRCUIT.
27
OUTPUT TO S.A.U. WARHEAD.

INFRA RED PROXIMITY FUZES

This invention relates to detecting the presence of a moving object or target and is particularly directed to the provision of an infra-red proximity fuze capable of responding to kinetic heating of an object or target and of appropriately discriminating against other radiation.

In the past passive infra-red fuze systems have depended primarily on three main radiation outputs from aircraft and missile targets for their operation. These are:

1. Near blackbody radiation from the hot exhaust stubs of piston-engined aircraft.

2. Near blackbody radiation from the exhaust nozzles of aircraft and missiles.

3. Molecular emission from the hot gases of the exhaust plumes of both jet aircraft and missiles, the important emitting species being the $CO_2$ and $H_2O$ molecules.

In particular, fuze systems appropriate for all-round attack missiles are required to be sensitive to the third radiation source listed above. However, as fuze systems have become more sensitive a potential problem has arisen in regard to premature fuze trigger on exhaust plumes.

When infra-red radiation signals are received from a jet aircraft it would appear at first sight that the signals should be greatest immediately behind the jet-pipe and decrease progressively with distance behind it. However, analysis of exhaust plume radiation signatures in both the spectral regions at 2.7 microns and 4.3 microns has revealed modulations or variations in the amplitude of these signatures. These modulations are concluded to be due to turbulence in the exhaust plume arising from contractions and expansions of the exhaust gases. Such modulations, in the case of highly sensitive fuze systems, could result in the fuze failing to distinguish them from the jet-exhaust plume/target structure discontinuity at the target jet-pipe and hence cause premature trigger.

There are several ways in which the modulation effect can be minimised by the infra-red fuze designer. However, it is much more satisfactory to eliminate the problem completely by spectrally rejecting the exhaust plume as a fuze trigger source and to substitute another radiation source which does not inherently produce such problems. A fuze operating on the principles described below provides such a solution.

According to the present invention, there is provided an infra-red proximity fuze system, characterised by a combination of optics and detector cells sensitive to radiation from the skin of a target due to kinetic heating, and insensitive to radiation from jet-exhaust plume radiation.

As aircraft or missile targets move at speed through the atmosphere, their structure becomes heated naturally. The magnitude of the radiation from the heated 'skin' is defined by the spectral region, the skin emissivity in this band and the temperature profile of the skin. The exact temperature occurring on the target skin at any point and time in flight is determined by the heat balance pertaining at the point in question. In general, however, the faster the target and the lower the altitude the hotter the skin will be.

Using the above principle, consider a target passing through the optical field of view of an infra-red fuze system. As the target passes through the field of view it substitutes its own radiating skin for the atmosphere background. The fuze system will react to the contrast in the radiations provided by the target and the atmospheric background, respectively, in the field of view. For a given spectral band the contrast may be either positive or negative, depending on the relative magnitudes of the target and background radiation. However, the infra-red fuze will respond equally well to either condition. In the spectral region beyond 5 microns background spectral radiances at high altitudes are relatively large for downward sightlines and relatively small for upward sightlines. At lower altitudes this is also true of 'window' spectral regions but in high absorption regions the background spectral radiances will tend to be more uniform. Hence, at high altitudes in general and at low altitudes for a window spectral region the fuze contrast or signature is likely at moderate target speeds to be opposite in 'sign' according to the sightline direction to the target from the fuze. The limit to the detection of the target in the presence of the prevailing background is set by the sensitivity of the fuze system.

The minimum wavelength response of a fuze operating on the kinetic heating radiation/background radiation differential, but rejecting exhaust plume radiation, is about 5 microns. At such a wavelength the magnitude of the exhaust plume radiation even under reheat conditions would be negligible compared with that required to trigger the fuze system.

The principle advantage of a fuze system operating in the manner described above lies in the fact that the fuze trigger point is now defined inherently within the spatial boundaries of the geometrical target. The rejection of the plume ensures that fuze trigger cannot occur outside the geometrical boundary whilst the kinetic heating sensing mode of operation provides the required operation within it.

To adopt the above philosophy regarding infra-red fuzing on targets does not require any significant modification to the hardware requirements of the fuze. Similar optics and electronic systems are required to those needed for exhaust-plume fuzing. However, in order to reject the exhaust plume as a trigger source a spectral cut-on filter at 5 microns is required. In addition, a detector is needed with sufficient sensitivity beyond 5 microns to provide fuze operation on the kinetically-heated target. This sensitivity is yielded by a Mercury Cadmium Telluride detector element cooled to a temperature not less than −40° C. The fuze window is also required to pass radiation within the spectral sensitivity region of the detector. Materials for the window are readily available including sapphire which is transparent to such radiation out to 7 microns.

Such a fuze system will now be described in more detail by way of example and with reference to the accompanying drawings, in which:—

Figure 2:
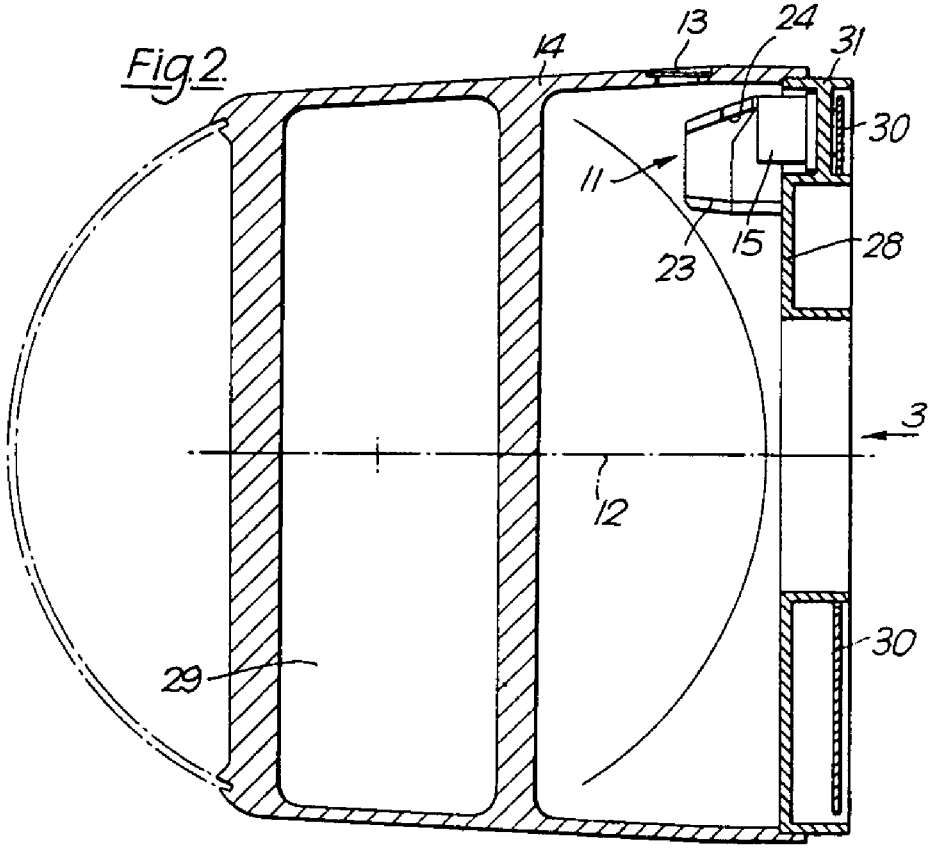
Figure 3:
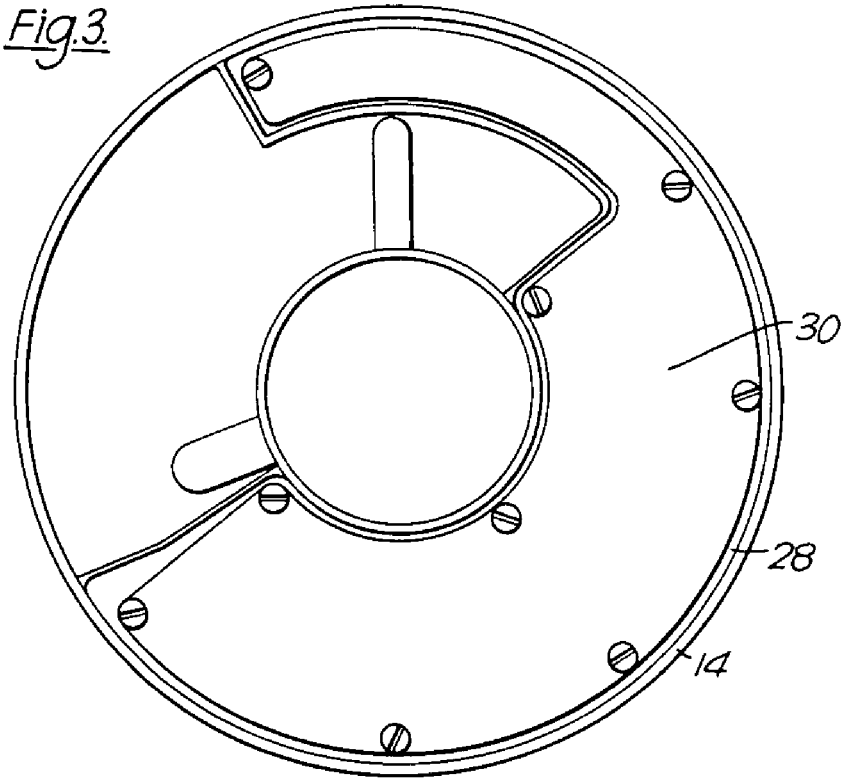
Figure 4:
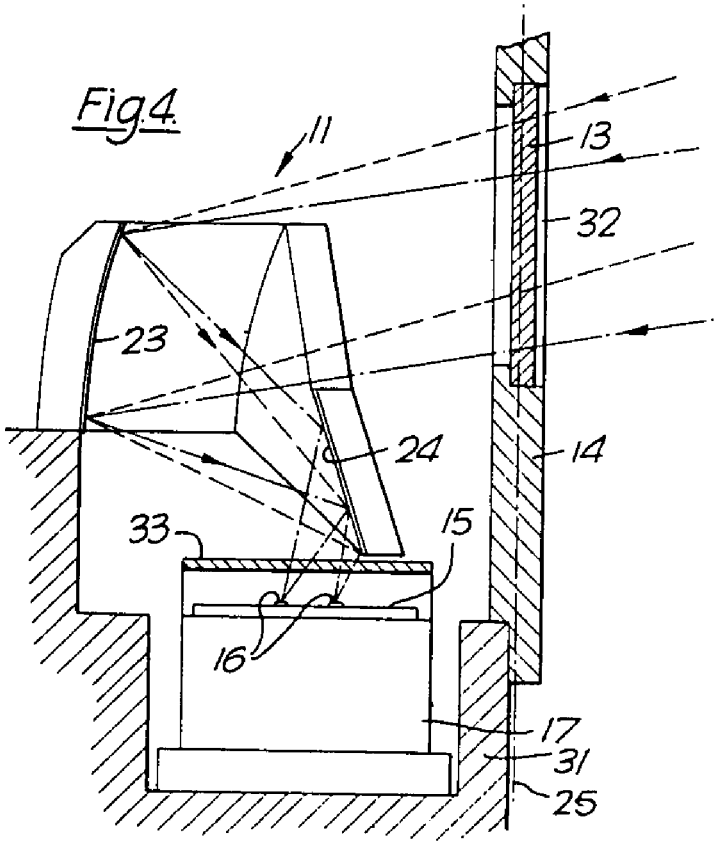
Figure 5:
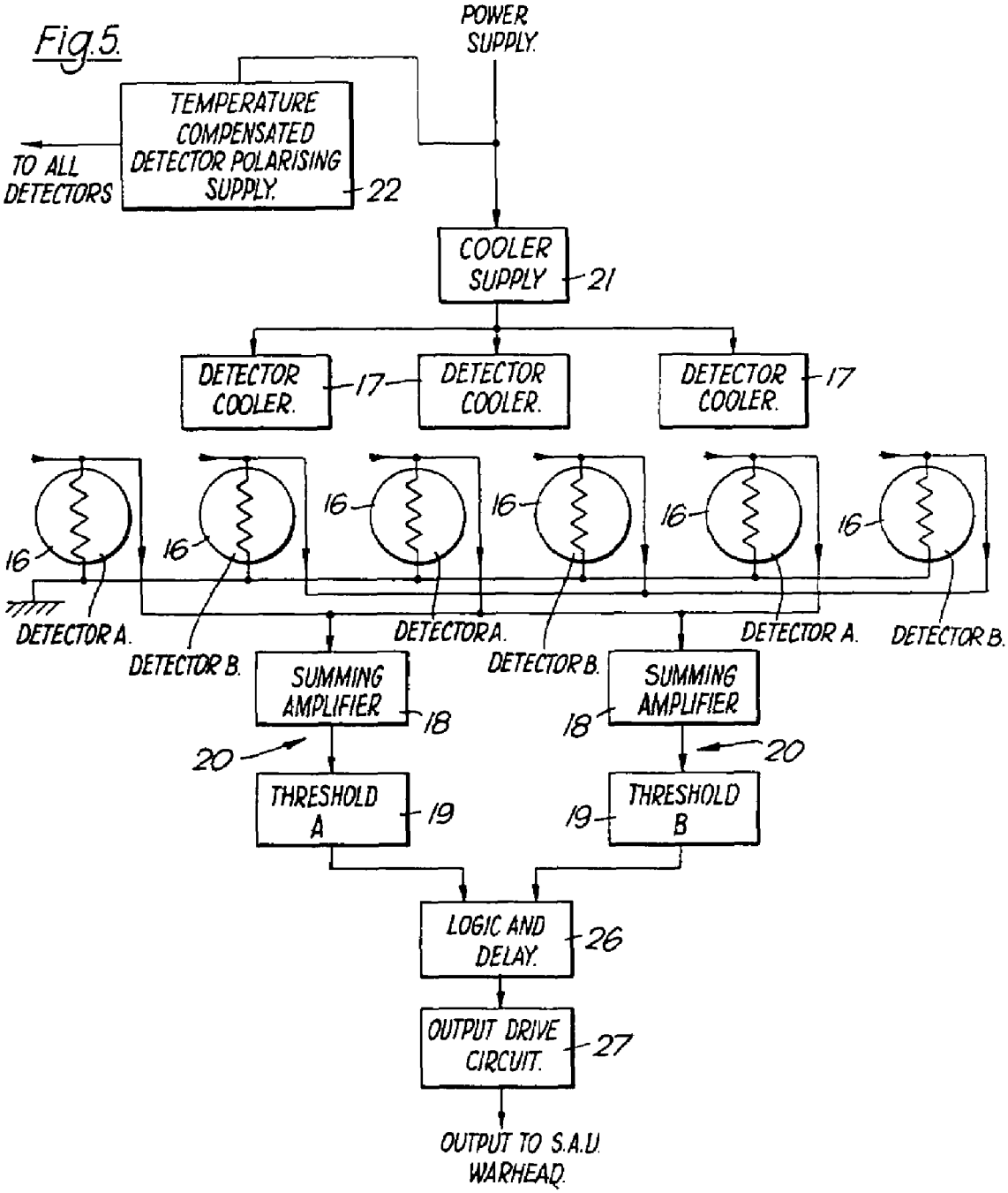

FIG. 1 is a diagrammatic front elevation of an infra-red proximity fuze installation at the nose of a missile, FIG. 2 is a view in section on the line 2-2 of FIG. 1, FIG. 3 is a view in the direction of the arrow 3 of FIG. 2, FIG. 4 is a diagram of one of three detector modules of the fuze installation of FIGS. 1 to 3, and FIG. 5 is a block diagram of the electrical system.

The prime feature of the solution to the problem is that the design is based upon a predominantly kinetic heating radiation sensing fuze system. Molecular emission from the exhaust gases of targets will be rejected almost totally by spectral means, although jet-pipe radiation will still be available to the fuze. The spectral bandwidth will be contained within the spectral region 5 microns to 7.0 microns. The precise bandwidth will be selected after spectral performance studies. The wavelength of peak response will, however, be about 6 microns.

The embodiment to be described is a fixed twin-beam fuze system provided by three optical modules 11 which are equispaced around the missile roll axis 12 to give a continuous transverse field of view via the three 'slit' windows 13 of the modules in the missile skin 14.

A Mercury Cadmium Telluride cell is employed for each detector 15, the element size of the two elements 16 of each detector being 0.5 mm×0.5 mm. Cooling of the detector elements 16 is by a twin stage thermoelectric cooler 17 which will provide a temperature differential of 80° C. from a detector element start temperature of +80° C. A separate cooler is provided for each pair of detector elements. The twin beam channels are formed by connecting three of the detector elements 16, one from each detector 15 (the 'A' elements), in common to constitute one beam channel, and the remaining three elements, one from each detector (the 'B' elements), to constitute the other beam channel.

The fuze electronic system design is based upon a single amplifier 18 and threshold system 19 for each beam channel 20 of the fuze, rather than a single amplifier and threshold per detector element, thereby keeping down the number of components.

The sensitivity of the fuze, as defined by its threshold irradiance, will be better than 2 micro-watts/cm$^2$ at 6.0 microns and 200 hertz. The spectral band of 5.0 microns to 7.0 microns has been adopted for the fuze system for a number of reasons. The first of these is to reject exhaust plume radiation in favour of a kinetic heating radiation sensing fuze. As already explained, this overcomes the problem posed by the inherently irregular nature of the exhaust plume signature. The irregularities, better known as modulations, could, particularly in the case of reheat plumes, defeat the principle of operation of highly sensitive fuze systems resulting in too early fuze trigger. By removing the sensitivity of the fuze to this radiation, the problem is met. A spectral filter/cutting on at about 5.0 microns will adequately remove the exhaust plume radiation even under reheat exhaust plume conditions. This has been substantiated by experiments with various cut-on filters against ground-run reheat engines.

The cut-on wavelength could have been selected at a much longer wavelength. However, no exotic infra-red materials are required with a 7.0 microns cut-off wavelength. For example, the fuze windows can be of sapphire. This window material is indeed the limiting factor on the long wavelength cut-off of the fuze system, but it is entirely adequate.

The fuze band itself is one in which considerable atmospheric absorption occurs due to water vapour. Atmospheric background radiation will tend to be relatively uniform with changing sightline due to the water vapour absorption. Sun radiation magnitudes will be small in the chosen spectral band. When the missile has a constant velocity vector the sun's bearing remains constant with respect to the missile axis. When the missile pitches the sun's bearing changes at the missile pitch rate. As a result it is possible that the sun could pass through the fuze beams at this rate. The firing beam is at 80° to the forward missile axis and is provided with a 'guard' beam 6° forward of that. For warhead initiation, the guard beam is triggered first and the firing beam is triggered within a small time interval thereafter. This interval is selected in design to be less than the time taken by the missile to pitch through 6° at the maximum pitch rate. The engagement trajectories of the missile are such that targets will generate signals in the guard and firing beams with a time interval less than the selected design value.

At the maximum missile pitch rate over 6° of 3.5 radians per second, slightly more than 29 milli-seconds is required to traverse 6°. Since fuze signatures will occur in the firing beam less than 10 milli-seconds after those in the guard beam the selected 'sun gate' interval is 15 milli-seconds rather than 29 milli-seconds as defined by the missile pitch rate. The smaller sun-gate time gives an outer fuze range cut-off in the region of 150 meters, without taking account of atmospheric absorption. For all practical purposes this range limit makes the fuze insensitive to unwanted sources of radiation.

The two 0.5 mm×0.5 mm Mercury Cadmium Telluride sensitive elements of each detector are mounted in a rugged encapsulation incorporating a thermoelectric cooler, a thermistor and a sapphire window. The thermoelectric cooler 17 is twin staged providing a differential temperature reduction at +20° C. of about 80° C. and at +80° C. of better than 90° C. for a drive current from the cooler supply 21 of about 2 amps at 2 volt. A cooler drive current of about 1 amp which will provide a differential temperature reduction of 80° C. at +80° C.

The thermistor mounted adjacent to the elements is provided to monitor the substrate temperature. If required, compensation can be provided in the circuits from a temperature compensated detector polarising supply 22 to minimise responsivity changes caused by variations in temperature. Alternatively, the element temperature can be stabilised by controlling the thermoelectric cooler current.

Typical performance figures for the detector at 0° C. are shown below for a polarising current in the range 3 to 5 milli-amps.

D* (6μ, 300, 1)—$3\times10^9$ cm Hz$^{y2}$/Watt

Responsivity at 6μ—150 volts/watt

Resistance—100 ohms

In practice, cooling of the detectors can be initiated from 'wheels up' time on the missile-carrying aircraft by utilising aircraft power supplies. At missile launch time the drive current to the coolers 17 will be provided by the missile power supply.

The two beam angles of the fuze system each cover the required 360° field of view about the missile roll axis by virtue of the three separate optical modules 11. Each module has associated with it the small 'slit' window 13 which has a flat and rectangular form that is both simple and cheap to manufacture and easily assembled into the missile skin. Use of such small discrete windows gives structural and space advantages as well as improvements in respect of R.F. radiation protection compared to a continuous window aperture system.

Each optical module 11 incorporates two mirror surfaces 23, 24 to focus the incident radiation on to the two detector elements 16 of each module. The primary powered mirror surface 23 of each module is of ogival form, the axis 25 of the ogive being centered along the 'slit' window 13 in the missile skin. The two detector elements 16 are arranged to lie on the line which is the image of the ogive axis 25 in the plane secondary mirror surface 24. The use of a secondary mirror surface allows the detectors to be placed in a position remote from the missile skin 14. The primary and secondary mirror surfaces 23, 24 are manufactured as an integral unit in polycarbonate plastic by an injection moulding technique. The optical surfaces are aluminised.

Each module 11 provides a transverse field of view marginally greater than 120° so that the three equi-spaced modules provide the 360° of field coverage around the missile roll axis.

Since the fuze detector is inherently very sensitive an electronic system comprising a single amplifier 18 and threshold circuit 19 per beam channel is employed rather than a single amplifier and threshold circuit per detector element, thereby considerably reducing the number of electronic components.

Each two-stage thermoelectric cooler 17 requires a drive current of 1 amp at 2 volts and, if desired, the three coolers of the system can be connected in series so that the total power requirement of the cooling system is 1 amp at 6 volts. As the missile supply line voltage is 28 volts a voltage converter is necessary. During aircraft carriage of the missile, the cooler drive can be provided via a switching regulator supply from the aircraft in order to achieve high efficiency. After missile launch, however, the current drive is provided from the missile supply via a series regulator in the fuze. A switching regulator would be unsuitable in this case due to probable pick-up between the detector and cooler. On the other hand before launch any such pick-up is irrelevant. The power dissipated due to the inefficiency of the series regulator will not affect the ambient temperature of the fuze during the 10.5 seconds of missile flight.

The Mercury Cadmium Telluride detectors 16 are photosensitive and require a polarising current supply. The polarising circuit will stabilise and filter the missile battery supply to provide an ultra noise free voltage supply. The noise and ripple level will be less than 1 μV r.m.s. at the detector due to this supply. The temperature to which the detectors are cooled will vary with ambient temperature. This varying temperature will produce varying responsivities from the detectors. To maintain stability of performance from the fuze with changing temperature, the polarising current to the detectors from the supply 22 is varied to provide the desired compensation, the detector temperature being monitored by the thermistors already discussed. This compensation is in addition to that provided by the summing amplifiers 18 now to be described.

Each amplifier system 18 consists of a stage to sum the outputs from the three detector elements 16 defining a single beam channel A or B and a gain stage to amplify the detector signal to a usable level.

The gain of the summing stage will be inversely proportional to the impedance of the detectors. This will achieve some temperature compensation for the variation in detector responsivity with operating temperature. This is brought about since the higher the operating temperature of the detector the lower the impedance of the detector, and the lower the detector impedance the lower is the detector responsivity but the higher is the amplifier gain—hence the compensation.

The gain stage of the system uses an integrated circuit linear amplifier with feedback to define a total system gain of the order of 50,000. The frequency of this amplifier will be approximately 70 Hz to 450 Hz with a 12 dB/octave low and high frequency roll off. The less steep low frequency roll off proposed compared with that associated with fuze systems using 'active' cooling systems improves the response of the system to kinetic heating radiation signals. The amplifier system is identical for each beam channel.

The threshold circuits 19 are linear differential amplifiers with positive feedback arranged as voltage level sensors. Whenever the output of an amplifier 18 exceeds the 'threshold' level an output pulse is produced, the output feeding the sun-gate logic circuit 26 of the fuze.

The sun-gate circuit 26 performs the logic necessary to allow rejection of direct solar radiation signals and other spurious signals by using pulse-generating and coincidence circuits to measure the time between signals on the two beam channels A, B of the fuze. When a signal voltage output, from a detector or detectors of the guard beam A, after amplification, exceeds the fuze threshold level, then a sun-gate pulse of 15 milli-seconds is produced. If the fuze threshold level is exceeded on the firing beam channel B within the sun-gate time, then an output is passed to the safety and arming unit of the warhead. If however the fuze threshold level in this latter channel B occurs at a time greater than the sun-gate time no output is produced.

If a delay between fuze trigger and warhead initiation is required, the sun-gate time of 15 milli-seconds is extended by the delay time. The duration of the firing channel output pulse is the delay time. Coincidence between these pulses for a time greater than the delay is an indication of a target and an output pulse is produced which drives an output circuit 27 producing an output suitable to trigger the warhead.

The fuze design may be considered in two parts. These are:

(1) The fuze assembly.

(2) The fuze windows 13.

The fuze assembly is located in the forward section of the missile, mounted on a separate bulkhead 28 behind the missile homing head 29. The fuze bulkhead 28 is made in aluminium or steel depending on the weight requirements of the fuze. The fuze assembly comprises the fuze optics, the fuze detectors and coolers and the fuze electronics.

The fuze optics consists of the three equi-spaced modules 11 mounted on the forward face of the fuze bulkhead 28. Each optical module consists of the moulded poly-carbonate powered mirror unit 23, 24 attached to a metal housing 31 of the bulkhead which encloses the detectors 16 and cooler 17. The detectors and cooler are bolted directly to the fuze bulkhead which acts as a heat sink for the cooler and also provides a rigid mounting against vibration.

The fuze electronics are contained on a single board 30 which is attached to the rear face of the bulkhead 28. The interwiring from the detectors passes directly to the board connections. The detectors 16 are protected from R.F. radiation by the metal housing 31 and the electronics by the bulkhead 28. Input and output wiring to and from the missile system is taken via R.F. filters screwed into the bulkhead.

The only machining external to the fuze occurs with the milling of the three small equi-spaced window slots at the rear end of the homing head 29. The slots 32 are recessed externally to give flush locations for the sapphire windows 13 which provide the infra-red target radiation entry points to the fuze optics. The windows are retained and sealed by an epoxy resin adhesive.

What I claim is:

1. An infra-red proximity fuze system, comprising a missile body having a roll axis and a peripheral skin around said roll axis, at least three fuze windows in said missile body skin spaced equidistantly around said missile body roll axis to give a 360° field of view said fuze windows being transparent to radiation up to 7 microns, and a plurality of optics/detector modules within the missile body equal in number to the number of fuze windows and each associated with a respective fuze window, each said optics/detector module including a detector cell sensitive to radiation from the skin of a target due to kinetic heating, and optical means directing radiation entering through the respective window on to said detector cell which optical means includes filter means having a lower cut-off wavelength of substantially 5 microns.

2. A fuze system according to claim 1, wherein the detector cells are Mercury Cadmium Telluride cooled to a temperature not less than −40° C.

3. A fuze system according to claim 1, wherein each module has first and second sensitive detector elements, the first detector elements of the three modules are connected in common to constitute a guard beam channel, and the second detector elements of the three modules are connected in common to constitute a firing beam channel, the guard beam field of view being angularly displaced in the forward missile axis direction with respect to the firing beam field of view.

4. A fuze system according to claim 3, wherein the angular displacement between the guard and firing beam fields of view is 6°.

5. A fuze system according to claim 3, wherein the guard beam and firing beam channels each comprise a single amplifier receiving the signal output of the common-connected first detector elements or the common-connected second detector elements, as the case may be, each said single amplifier has a signal threshold circuit connected on its output, and both threshold circuits feed their outputs to sun-gate logic circuitry.

6. A fuze system according to claim 5, wherein the sun-gate logic circuitry is arranged to deliver an output pulse only if it receives input pulses from the guard beam and firing beam channels in turn at an interval between the pulses of not greater than a preselected delay time.

7. A fuze system according to claim 6, wherein the preselected delay time is 15 milli-seconds.

8. A fuze system according to claim 5, wherein each amplifier comprises an input summing stage followed by a gain stage, and the gain of the summing stage is inversely proportional to the impedance of the detector elements on the input of the amplifier.

9. A fuze system according to claim 8, wherein the gain stage of the amplifier has a low frequency roll-off of substantially 12 dB/octave.

10. A fuze system according to claim 1, wherein thermistors are mounted in association with said detector cells and are connected to give temperature compensation in a polarising current supply circuit supplying said detector cells.

11. A fuze system according to 1, wherein the optical means of each module comprise a powered mirror followed by a plane mirror, the two mirrors being moulded as a unit.

12. An infra-red proximity fuze system, comprising detector cells sensitive to radiation from the skin of a target due to kinetic heating, and optical means directing target radiation on the said detector cells which optical means comprise filter means having a lower cut-off wavelength of substantially 5 microns and an upper cut-off wavelength of substantially 7 microns, said detector cells being Mercury Cadmium Telluride cooled to a temperature not less than 40° C.

* * * * *